United States Patent [19]

Heikkinen

[11] 4,432,403

[45] Feb. 21, 1984

[54] PROCEDURE AND APPARATUS FOR BARKING TIMBER

[75] Inventor: Urho Heikkinen, Helsinki, Finland

[73] Assignee: Kone Oy, Helsinki, Finland

[21] Appl. No.: 266,104

[22] Filed: May 21, 1981

Related U.S. Application Data

[63] Continuation of Ser. No. 44,777, Jun. 1, 1979, abandoned, which is a continuation of Ser. No. 864,226, Sep. 26, 1975, abandoned, which is a continuation of Ser. No. 617,056, Sep. 26, 1975, abandoned.

[30] Foreign Application Priority Data

Sep. 27, 1974 [FI] Finland ..... 2833/74

[51] Int. Cl.[3] ..... B27L 1/00

[52] U.S. Cl. ..... 144/342; 144/208 B; 144/208 D

[58] Field of Search ..... 144/208 R, 208 B, 208 D, 144/208 E, 208 F, 340, 342, 341

[56] References Cited

U.S. PATENT DOCUMENTS 2,490,165 12/1949 Shaw ..... 144/208 D
2,809,683 10/1957 Hoiss ..... 144/208 F
3,272,245 9/1966 Dick et al. ..... 144/208 B

FOREIGN PATENT DOCUMENTS 598278 5/1934 Fed. Rep. of Germany .
1166450 10/1964 Fed. Rep. of Germany .

OTHER PUBLICATIONS

Holz (German Journal) Zentralblatt, (1969), *Modern Debarkers–Their Technological and Economical Aspects*, Holz-Zentralblatt, Stuttgart, 95, 1969, Rah-Und Werkstoff.

*Primary Examiner*—W. D. Bray
*Attorney, Agent, or Firm*—Martin Smolowitz

[57] ABSTRACT

A procedure and an apparatus for barking timber, wherein the timber is barked by the frictional barking method, and it is pretreated prior to barking in order to render the friction barking more efficient. In the pretreatment the timber is patched, that is partly barked, in that bare patches are produced in the bark of the timber, that is spots from which the bark has been removed, preferably by at least one water jet directed against the bark.

17 Claims, 11 Drawing Figures

PROCEDURE AND APPARATUS FOR BARKING TIMBER

This is a continuation of application Ser. No. 044,777 filed June 1, 1979, now abandoned, which is a continuation of Ser. No. 864,226 filed Sept. 26, 1975, now abandoned, which is a continuation of Ser. No. 617,056 filed Sept. 26, 1975, now abandoned.

According to a method known in the prior art, the barking of timber to be defibrated is usually accomplished by frictional barking in a barking drum. In the rotating drum the pieces of timber are set in motion, whereby they rub against each other and against barking irons mounted on the inner surface of the cylindrical drum. The bark is detached and falls through bark slits in the mantle of the drum, and they are carried off. Water jetted into the drum aids the detachment of the bark and its escape through the bark slits. The barking drum is placed in a slightly slanting position, whereby the pieces of timber progress through the drum. The barking time and the degree of cleanness of the timber may be controlled by controlling the outflow quantity of timber by adjusting the height of an exit end flap.

Pretreatment methods known in prior art are: soaking and steaming of the timber. These are applied in an endeavour to influence the cell tissue between the bark and the wood so as to decrease its bonding strength. In earlier days such treatment took place while the timber was transported by floating along waterways. The timber could then remain in the water for prolonged periods, whereby the bonding strength between the bark and the wood was greatly reduced and no difficulties were experienced in the barking process. Nowadays, however, the transport of timber is increasingly by road or by rail and this naturally introduces the drawback that the bark dries fast to the wood.

In order to be efficient, the soaking pretreatment requires a considerable soaking time and rather large quantities of water. The abundant use of water in its turn results in lots of waste water, which implies high water purification costs. Also steaming would have to continue for a long time so that the steam may penetrate the cell tissue between the bark and the wood. This involves a high expenditure of expensive heat energy.

Attempts have therefore been made to practice friction barking altogether without pretreatment. In that case the pieces of timber are fed into the barking drum and they are there rotated for such a long period that the bark will come off. But this development has led to exceedingly long barking times, because it has been observed that from the moment when the timber is fed into the barking drum a long time passes before the bark begins to come off. It is now a consequence of the long barking time that the pieces of timber are knockded as under and the proportion of wood lost along with the bark becomes high. It is a further drawback of this method that the long barking time requires a long barking drum, whereby the apparatus will be quite expensive.

SUMMARY OF INVENTION

The object of the present invention is to eliminate drawbacks and to provide a procedure and apparatus considerably more efficient than those known in prior art. The invention is substantially characterized in that in the pretreatment the timber is laid bare in spots, that is partly barked in that patches or spots are made in the bark where the bark has been removed.

The method of the invention is based on the fact that in frictional barking the rate of barking is directly proportional to the length of the demarcation line between barked and unbarked timber. Now when in the pretreatment bare patches are caused to appear in the bark, the length of this line can be made large even before the pieces of timber are introduced into the barking drum. It follows that the barking of the timber in the drum commences immediately. It is obvious that very great time savings are hereby achieved. The barking drum may also be made shorter and less expensive. Furthermore the losses of wood are less, owing to the shorter barking time.

The inventive apparatus constitutes a frictional barking apparatus, such as a barking drum, for the barking of the timber, and a pretreatment device for increased efficiency of barking. The pretreatment devices known in prior art include a soaking basin and a steam chamber, through which the pieces of timber to be barked are conveyed by means of a conveyor. However, these are afflicted with the drawbacks already described above in connection with the pretreatment methods of prior art. The device of the present invention is free of these drawbacks.

The invention is characterized in that the pretreatment device has a patching unit through which the timber to be barked is fed and wherein mechanically, with the aid of solid bodies or of a pressure fluid, bare patches are produced in the bark, that is spots where the bark has been removed. Hereby the length of the demarcation line between barked and unbarked timber increases and the barking process comes under way immediately in the barking drum.

In an preferred embodiment, the patching device consists of at least one nozzle through which a knife-like water jet is directed obliquely against the bark of the piece of timber under pretreatment. The water jet when produced under high pressure is as efficient as a solid body.

In another suggested embodiment, the patching device consists of at least two press rolls between which the timber to be pretreated is guided and which are provided with sharp patching members on such as spikes.

In a third exemplary embodiment, the patching device consists of one or several blades which produce bare patches in the bark when the timber rotates.

In still another recommended embodiment, the patching device consists of one or several chains arranged to move so that when passing over the timber under pretreatment they produce bare patches in its bark.

The invention is described in the following with the aid of examples, with reference to the attached drawings, wherein FIG. 1 presents a barking graph of timber in a conventional frictional barking drum;

Figure 4:
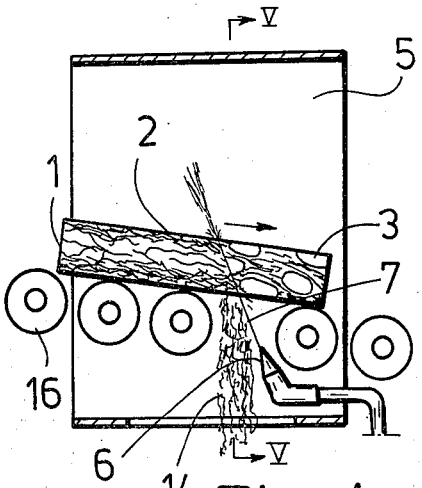
FIG. 4 shows a pretreatment device according to the invention in a vertical section.
Figure 6:
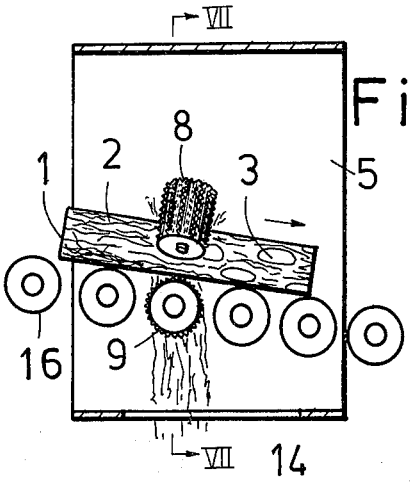
Figure 7:
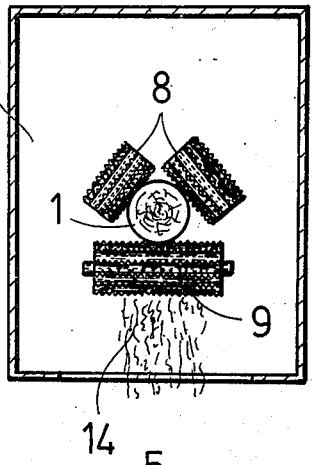
Figure 8:
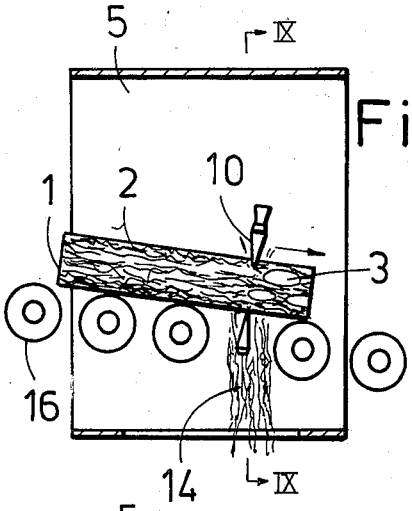
Figure 9:
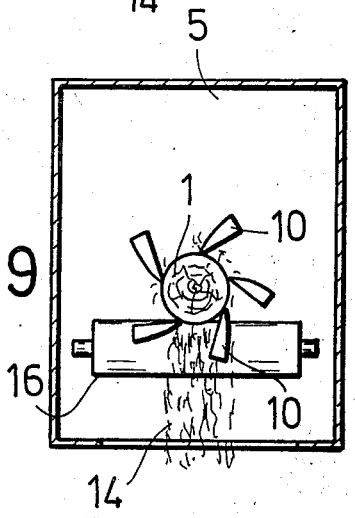
Figure 10:
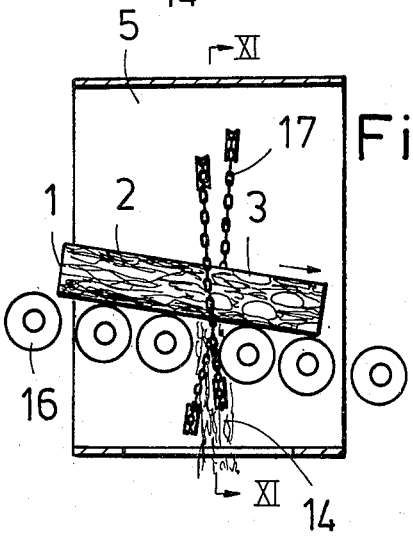

FIG. 6 corresponds to FIG. 4, showing another embodiment;

FIG. 7 shows a section along the line VII—VII in FIG. 6;

FIG. 8 corresponds to FIG. 4 and shows a third embodiment;

FIG. 9 shows a section along the line IX—IX in FIG. 8;

FIG. 10 corresponds to FIG. 4 and shows a fourth embodiment; and

Figure 11:
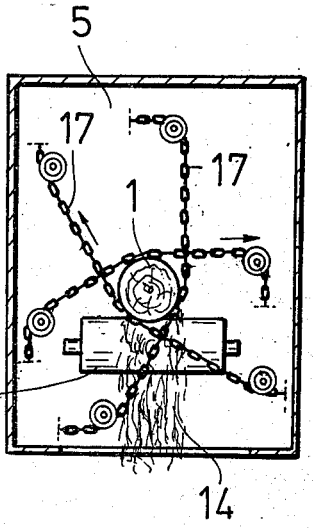

FIG. 11 shows a section along the line XI—IX in FIG. 10.

Figure 1:
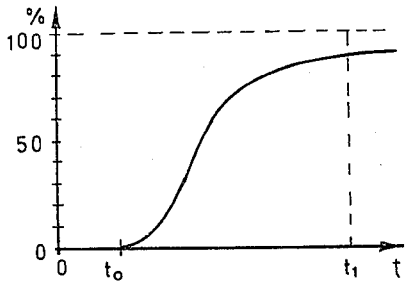

In FIG. 1 a so-called drum barking graph has been shown, as the barking process proceeds in a conventional friction barking drum. The figure has on the vertical axis the percentage of barking accomplished and on the horizontal axis the time. It is seen from the graph that the degree of barking, expressed as a percentage, is zero during the time from 0 to $t_0$. This is because the pieces of timber have to be rotated in the barking drum for a considerable length of time before the barking starts. It is further seen that after the time $t_0$ the degree of barking increases at a powerful rate. The barking rate is highest when the demarcation line between barked and unbarked timber has its maximum length. It is further seen from the graph that on approaching the 100% degree of barking, the barking rate slows down. This is quite natural since when there is only little bark left, the demarcation line mentioned also has a small length. At a certain time $t_1$ the degree of cleanness of the timber is high enough for the subsequent process.

According to the invention the friction barking time can be substantially curtailed by producing bare patches in the bark of the timber, that is spots where the bark has been partially removed. Hereby the length of the demarcation line between barked and unbarked timber is made long already at the moment when the pieces of timber are introduced in the barking drum. As a consequence hereof the barking starts immediately.

This is perspicuously understood with reference to FIG. 1 in that, while the starting point in the conventional friction barking process is at 0, it is in fact at $t_0$ in the process according to the invention. Therefore the time interval from 0 to $t_0$ is altogether omitted. It goes without saying that reducing this time interval has great economic significance. Another consequence of the shorter barking time is that the pieces of timber which are rotated in the barking drum remain better intact and the loss of wood material is reduced.

Figure 2:
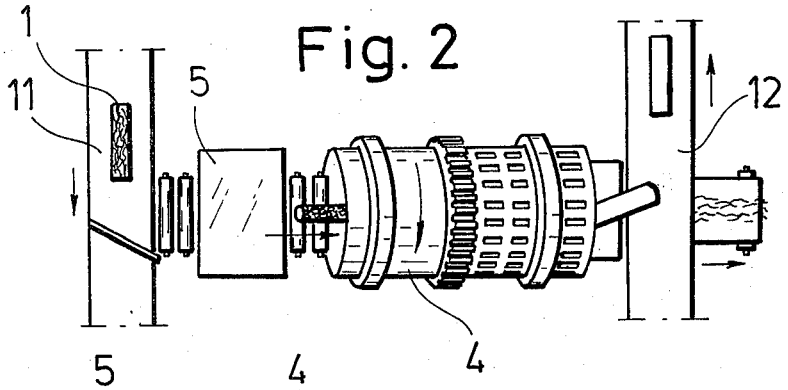
FIG. 2 shows, seen from above, a barking apparatus according to the invention.

In FIG. 2 an apparatus according to the invention is shown, comprising a barking drum 4, a pretreatment device 5, and conveyors 11 and 12. The same apparatus is seen in an elevational view in FIG. 3. The timber is conducted from the conveyor 11 into the pretreatment device 5 where the patching takes place and thereafter into the barking drum 4 where the final barking takes place. The conveyor 12 carries the barked pieces of timber towards further treatment steps. Loose pieces of bark 14 falling out from the patching device and through slits 13 of the barking drum are carried off by means of a conveyor 15.

Figure 3:
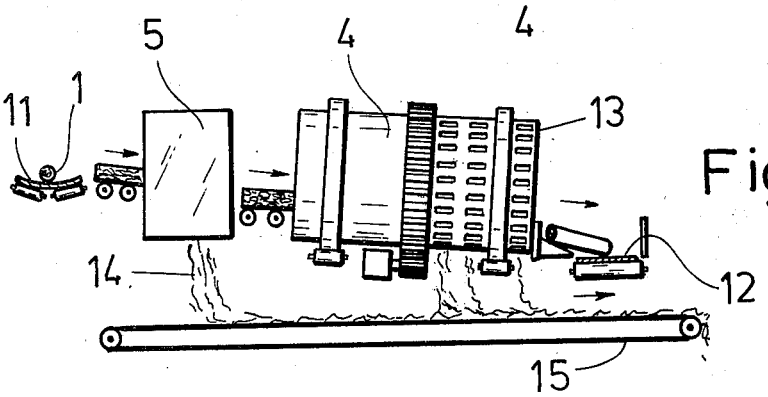
FIG. 3 shows the apparatus of FIG. 2 in an elevational view.

In FIG. 4 the pretreatment device 5 of FIG. 3 is presented in a vertical section. The timber 1 to be treated is conducted upon rollers 16 through the patching device. The patching is effected by means of a powerful knife-like water jet 7 which is directed preferably obliquely against the bark 2 of the timber 1 from the nozzle 6. In the bark coat 2 bare patches 3 are produced, and the detached pieces of bark 14 fall downwardly to be carried off.

Figure 5:
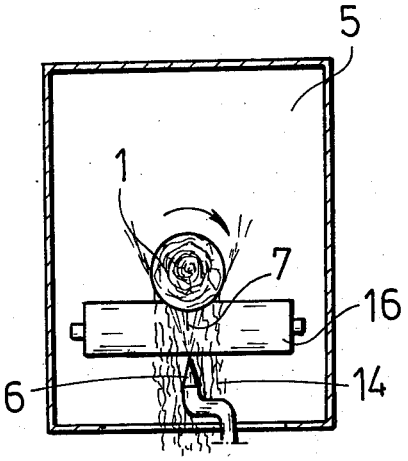
FIG. 5 shows a section along the line V—V in FIG. 4.

FIG. 5 shows the patching device of FIG. 4, viewed from another direction. It is recommended that the timber under treatment is set in rotatory motion. In FIG. 5 the water jet 7 is directed to impinge on the timber from below, but it may be directed to come from any other direction as well.

In the embodiment shown in FIGS. 6 and 7, the patching device consists of spiked rolls 8 and 9 which press the piece of timber to be treated between them. In order to render the patching action more efficient, the roll rotations can be made different in their speed, and the piece of timber 1 may be rotated.

In the embodiment of FIGS. 8 and 9, the patch producing memers are blades 10 mounted on various sides of the timber. In this case too it is advisable that the piece of timber 1 is arranged to rotate.

In the embodiment shown in FIGS. 10 and 11, there are three chains 17 which encircle the piece of timber 1 to be treated and trail along its surface. This causes the bark 2 to be detached in spots, producing the bare patches 3. The chains may be set in motion and the piece of timber may be rotated in order to enhance the action.

It is obvious to one skilled in the art that different embodiments of the invention may vary within the scope of the invention. For instance, it is possible to provide in the barking drum, in a manner known in the prior art, water jets or in addition even steam jets. It is understood that the penetration of steam between the wood and the bark is substantially more efficient in the case of patched timber than in that of unpatched timber.

The pretreatment device may also be further improved from the basic types presented above. What is essential is that bare patches are produced on the timber before it is conducted into the barking device proper. It is thus understood that the patching process may be employed as a pretreatment in nearly any kind of barking process.

What I claim is:

1. A hydraulic-mechanical method for the barking of timber highly resistant to frictional barking, wherein removal of bark occurs in a second step by frictional barking, said process comprising the steps of: pretreating the timber by at least one knifelike, thin water jet at high pressure directed obliquely against the timber, thereby producing incision spots in the bark surface of the timber and partly removing the bark so as to allow more efficient subsequent barking action by frictional barking forces; and conveying the pretreated partially barked timber into a rotating barking drum for final efficient barking therein starting from the edges of the bare spots of the timber.

2. A method for barking timber wherein the timber is pretreated prior to frictional drum barking to render the drum barking more efficient, comprising:

(a) pretreating the timber by first partly removing the bark therefrom in spots and patches so as to produce bare spots and patches on the timber and provide an extended demarcation line for the bare patches between the barked and unbarked timber; and (b) feeding the pretreated partially barked timber having bare patches into a rotating barking drum and removing the remaining bark therefrom by frictional barking for final efficient barking of the timber.

3. The timber barking method of claim 2, wherein said timber is pretreated for partial removal of the bark by directing at least one high pressure water jet obliquely at the bark while moving the timber past the jet.

4. The timber barking method of claim 2, wherein said pretreating of the timber is accomplished by removing localized patches of bark by a high pressure knife-like water jet directed obliquely against the bark of the moving timber.

5. The timber barking method of claim 2, wherein said pretreating is accomplished by moving the timber through at least two rotating press rollers containing sharp patching members which are pressed against the moving timber.

6. The timber barking method of claim 2, wherein said pretreating is provided by moving the timber past multiple chipping blades which contact and remove the bark and produce bare patches.

7. The timber barking method of claim 2, wherein said pretreating is provided by moving the timber past at least three moving chains maintained in frictional contact with the timber so as to remove the bark in patches.

8. A method for barking timber wherein the timber pieces are pretreated prior to frictional drum barking to render the drum barking more efficient, comprising the steps:

(a) pretreating the timber pieces first by partly removing the bark in spots and patches by directing at least one high pressure water jet obliquely against the bark of the rotating timber so as to remove the bark therefrom and produce localized bare spots and patches and thereby provide an extended demarcation line for the bare barked spots; and (b) feeding the pretreated partially barked timber pieces having bare spots and patches into a rotating drum and further removing the remaining bark therefrom by mechanical drum frictional barking for final efficient barking of the timber pieces.

9. An apparatus for efficient barking of timber, comprising:

(a) pretreatment means for enhancing the efficiency of barking timber, whereby the timber pieces to be barked are fed through said pretreatment means and the bark is partly removed from the timber in patches to produce bare spots in the bark; and (b) a rotatable barking drum through which the pretreated timber is conducted for additional and final efficient friction barking of the timber.

10. The barking apparatus according to claim 9, wherein the pretreatment means comprises at least one nozzle through which a knife-like high pressure water jet is directed obliquely against the bark of a moving piece of timber to produce the bare spots in the bark.

11. The barking apparatus according to claim 9, wherein the pretreatment means comprises at least two press rolls between which a piece of timber to be pretreated is conducted, with the surface of the rolls being provided with sharp spiked patching members for partly removing the bark in patches to produce the bare spots in the bark.

12. The barking apparatus according to claim 4, wherein the press rolls are rotated at different rotational speeds.

13. The barking apparatus according to claim 9, wherein the pretreatment means comprises at least one blade contacting the bark so that when the piece of timber rotates bare spots are produced in its bark.

14. The barking apparatus according to claim 9, wherein the pretreatment means comprises at least one chain which is arranged to be in motion relative to the timber bark so that when said chain passes over a piece of timber being pretreated bare spots are produced in the bark.

15. The barking apparatus according to claim 14, wherein three chains encircle the timber pieces while they are being rotated to produce bare patches in the bark.

16. The barking apparatus according to claim 9, wherein the barking drum contains slits through which loose pieces of bark are removed.

17. The barking apparatus according to claim 9, wherein water jets are provided within the barking drum to facilitate the final barking of the timber.

* * * * *